US008821071B2

(12) United States Patent
Aurora et al.

(10) Patent No.: US 8,821,071 B2
(45) Date of Patent: Sep. 2, 2014

(54) CONICAL PILED MONOPOD

(75) Inventors: Ravi P. Aurora, Sugar Land, TX (US); Thomas E. Ramsey, Houston, TX (US); Randall S. Shafer, Houston, TX (US); Peter G. Noble, Spring, TX (US); Ted H. Westerman, Sugar Land, TX (US); Dominique P. Berta, Katy, TX (US)

(73) Assignee: ConocoPhillips Company, Houston, TX (US)

( * ) Notice: Subject to any disclaimer, the term of this patent is extended or adjusted under 35 U.S.C. 154(b) by 247 days.

(21) Appl. No.: 13/277,755

(22) Filed: Oct. 20, 2011

(65) Prior Publication Data

US 2012/0128433 A1 May 24, 2012

Related U.S. Application Data

(60) Provisional application No. 61/414,950, filed on Nov. 18, 2010.

(51) Int. Cl.
*E02B 17/02* (2006.01)
*E02B 17/00* (2006.01)

(52) U.S. Cl.
CPC ..... *E02B 17/0021* (2013.01); *E02B 2017/0069* (2013.01); *E02B 2017/0065* (2013.01); *E02B 17/025* (2013.01); *E02B 17/027* (2013.01); *E02B 2017/0073* (2013.01); *E02B 2017/0086* (2013.01)
USPC ..... 405/217; 405/203

(58) Field of Classification Search
CPC ..... E02B 17/0021; E02B 17/02; E02B 2017/0065
USPC ..... 405/203, 211, 217, 227; 114/40
See application file for complete search history.

(56) References Cited

U.S. PATENT DOCUMENTS

| | | | | |
|---|---|---|---|---|
| 3,793,840 | A | 2/1974 | Mott et al. | |
| 3,972,199 | A * | 8/1976 | Hudson et al. | 405/217 |
| 4,239,418 | A * | 12/1980 | Pearce | 405/211 |
| 4,245,929 | A * | 1/1981 | Pearce et al. | 405/211 |

FOREIGN PATENT DOCUMENTS

GB 2017794 10/1979

OTHER PUBLICATIONS

PCT/US2011/057095 PCT International Search Report Dated May 30, 2013.

* cited by examiner

*Primary Examiner* — Tara M. Pinnock
(74) *Attorney, Agent, or Firm* — ConocoPhillips Company

(57) ABSTRACT

A conical piled monopod provides a fixed, ice worthy structure used in cold weather offshore environments for accessing hydrocarbon deposits under the seafloor.

20 Claims, 4 Drawing Sheets

CONICAL PILED MONOPOD

CROSS-REFERENCE TO RELATED APPLICATIONS

This application is a non-provisional application which claims benefit under 35 USC §119(e) to U.S. Provisional Application Ser. No. 61/414,950 filed Nov. 18, 2010, entitled "Conical Piled Monopod," which is incorporated herein in its entirety.

STATEMENT REGARDING FEDERALLY SPONSORED RESEARCH OR DEVELOPMENT

None.

FIELD OF THE INVENTION

This invention relates to ice worthy platforms for offshore development of hydrocarbon resources from undersea formations where ice is a potential issue.

BACKGROUND OF THE INVENTION

In the quest to bring new sources of hydrocarbons such as crude oil and natural gas to market, the Arctic Ocean and other ice prone areas are among the few areas where large reserves of such hydrocarbons are believed to be found. A majority of arctic offshore oil and gas reserves in the arctic are found at locations where the moving ice is multi-year ice, i.e. ice that did not melt during the summer following its formation and has become compacted and harder during the subsequent years. The hazards of exploring, drilling and producing in such environments are generally recognized, but cost effective solutions are not readily available. It is commonly known in the industry that costs for bringing hydrocarbon resources to market are considerably higher when the resources are either offshore versus onshore or in a remote or harsh environment versus a hospitable, non-arctic, and populated location. In offshore arctic projects, costs are astronomically higher due to the combination of all those factors and preparations for contending with multi-year ice increases costs even further.

One area of the significant cost components in an arctic offshore development project is the cost of the platform that is suitable to resist the forces exerted by multi-year ice floes. Current conventional technology comprises Gravity-Based-Structures or GBS which are huge steel or reinforced concrete structures that are floated from the fabrication site to the development location and lowered to the seafloor. High specific gravity minerals, e.g. Hematite (Iron ore mineral), or metal pellets are used to fill the compartments within the GBS until the total weight of the structure is sufficient to resist any sliding and overturning forces the moving ice floe might impose on it. It is conventional to provide the GBS with sloped perimeter surfaces so that as ice engages the structure, the ice slides upwards to bend and break along the slope surfaces. The ice is effectively turned away from the GBS although significant pressure can be created by ice, especially from multi-year ice that may exceed twenty meters in thickness.

Typically, a GBS is quite a bit wider than it is tall. Currently, a conventional GBS costs between 500 million to more than a billion US dollars depending on the water depth, number of drillings rigs supported on the platform, and the thickness of the expected multi-year ice. Seafloor preparation is a considerable expense item which typically comprises the extensive removal of soft and muddy materials directly beneath the base of the GBS and replacing it with hundreds of thousands of tons of gravel to form a firm, level gravel bed for the GBS to be safely supported without permitting much settlement. In some circumstances, especially when the water depth is deeper than 20 meters, design considerations include building up the seabed or building a taller GBS, and each alternative is quite expensive. The size of the GBS and costs for installing one at an ice-prone offshore location makes the GBS suitable only for fields that are proven to have very large reserves and that have high production rates. The cost of a GBS can be prohibitive if there is a substantially thick layer of very soft soils that must be replaced with well compacted granular material to ensure safe and adequate bearing strength of the soil upon which the GBS will be supported. There are or will be fields that could be significant producers of oil and natural gas that are not large enough to justify the enormous cost of a GBS.

BRIEF SUMMARY OF THE DISCLOSURE

The invention more particularly includes a conical piled monopod for use in ice prone offshore environments wherein the conical piled monopod includes a body with a base at the bottom and a deck at the top, wherein the base includes an arrangement for attaching to pilings driven into the seafloor. When the conical piled monopod is installed for use, a shoulder, a neckline and an inclined ice engaging surface around the body extending from the shoulder to the neckline such that the ice engaging surface is inclined from a wider lower region at the shoulder to a narrower neckline and where the shoulder is arranged to be below the sea surface and the neckline is arranged to be above the sea surface. A top deck is arranged at the top of the body such that the top deck is at least 60 meters across and the conical piled monopod structure has a density of less than about 0.20 tonnes/$m^3$.

The invention further relates to a method for providing a structure at a hydrocarbon production location in an ice prone offshore environment. The method includes providing a monopod structure having a body, a base at the bottom and a deck at the top that is at least 75 meters across and wherein the body has a density of less than about 0.20 tonnes/$m^3$. The monopod structure is moved to the hydrocarbon production location which has undergone essentially no preparation to the seafloor at the hydrocarbon production location such as by excavating, leveling, or additional replacement granular compacted material added to the seafloor. The base is lowered to the essentially unprepared seabed with the top deck above the sea surface and relatively level. Pilings are driven into the seafloor and attached to the base of the monopod to hold the monopod structure in place against the forces of wind, sea and ice. A sloped ice engaging surface is provided on the monopod that extends from below the sea surface to above the sea surface so as to bend ice that comes in contact with the monopod structure and cause the ice to break, resulting in reduced lateral forces on the structure compared to a vertical faced surface.

BRIEF DESCRIPTION OF THE DRAWINGS

A more complete understanding of the present invention and benefits thereof may be acquired by referring to the following description taken in conjunction with the accompanying drawings in which.

DETAILED DESCRIPTION

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

Figure 1:
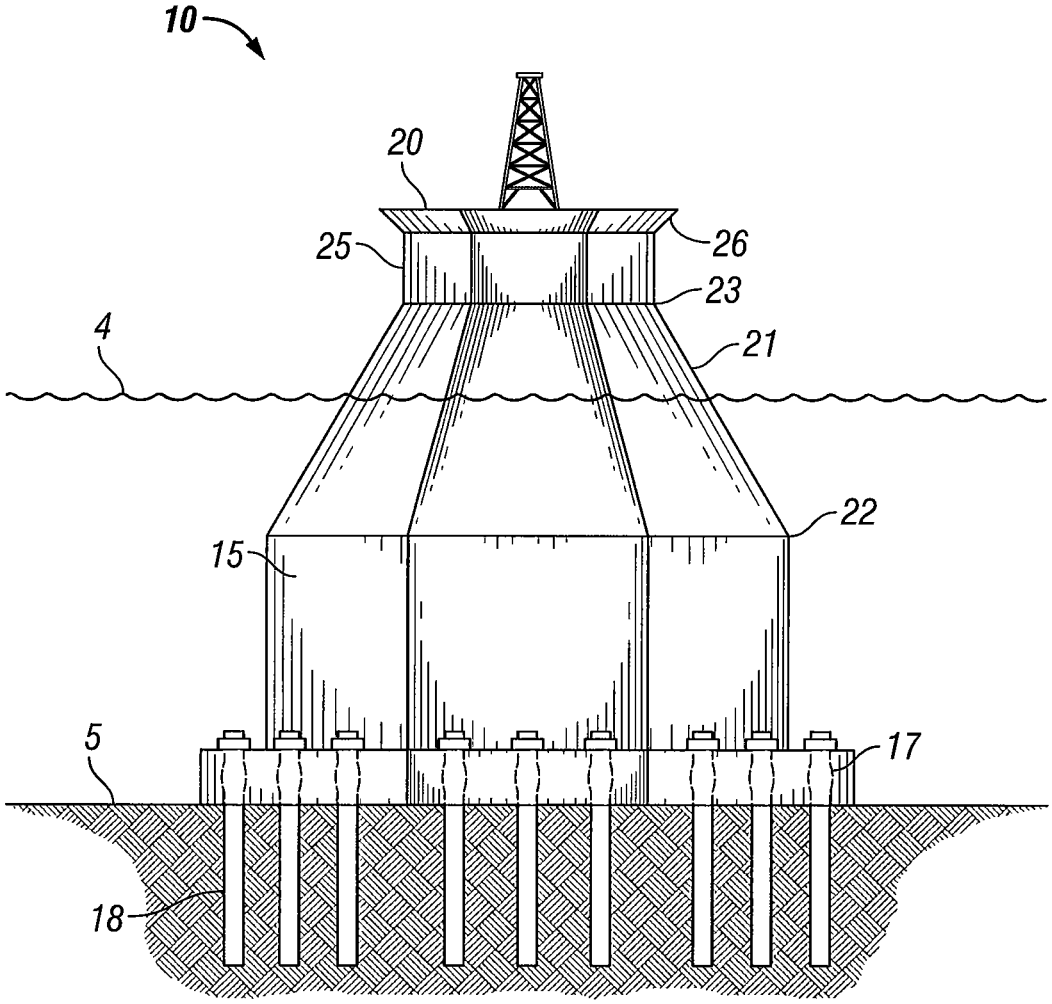
FIG. 1 is an elevation view of a first embodiment of the present invention related to a conical piled monopod.

As shown in FIG. 1, a conical piled monopod is generally indicated by the numeral 10. A conical piled monopod 10 is a structure that may be used in ice-prone, offshore locations at lower cost as compared to conventional GBS technology. A conical piled monopod 10 includes a body 15, a base 17 and a top deck 20. The base 17 preferably has the form of a flange with holes or perforations spaced around the perimeter of the conical piled monopod 10. The base 17 is arranged to rest on the seafloor 5. While the conical piled monopod 10 rests on the seafloor, the weight of the conical piled monopod is preferably carried by a plurality of pilings 18 that are driven deep into the seafloor 5 and then attached to the conical piled monopod 10. It is typical to drive the pilings 18 between about 35 and about 75 meters into the seabed to permanently fix the conical piled monopod 10 in its offshore location. The pilings 18 are typically strong, but hollow tubes or pipe like structures that act like long nails and provide a very structurally efficient arrangement for a permanent platform for offshore hydrocarbon drilling and production operations. The pilings have a relatively large diameter of between 1 and 3 meters with a wall thickness of about 2 to 10 cm. One particular advantage of the present invention is that with the weight of the conical piled monopod 10 supported by the pilings 18, little or no seabed preparation is necessary prior to installation and to the extent there is any seabed preparation, it is principally to create a level seafloor to set the conical piled monopod 10 onto as the pilings 18 are installed. A seabed comprising soft, muddy materials is not likely to be excavated and replaced with firmer materials.

With the conical piled monopod 10 supported by the pilings 18, preparation of the seafloor for installation of the conical piled monopod 10 is minimal or none. It is optional to provide some granular material to the seafloor to moderate an extremely sloped seafloor and have the base 17 rest on the granular material while the pilings 18 are installed, however, seafloor preparation would be an avoidable cost. Once the pilings 18 are driven into the seafloor and firmly attached to the base 17, the pilings 18 provide resistance to: (a) forces that cause structures to slide along the seafloor, (b) forces that cause structures to overturn such as forces acting several meters above the base of a structure; and (c) forces that cause vertical movement both upwardly and downwardly. The resistance to both upward and downward motion or movement is important in resisting toppling forces that may be imposed by ice. The pilings 18 at the front side of the conical piled monopod 10 resist lifting forces that ice may impose on the upstream side to resist toppling over while the pilings 18 at the far side or back side or downstream side of the conical piled monopod 10 resist downward motion that would allow the back side to roll deeper into the seafloor 5. Using such long pilings provides a structurally efficient base for year around operations in an ice prone offshore ice environment that must resist ice loads that can be quite substantial. The pilings act like nails that hold the platform in place and are structurally more efficient than in the case of a GBS where resistance to overturning is provided only by the size and weight of the structure.

Figure 6:
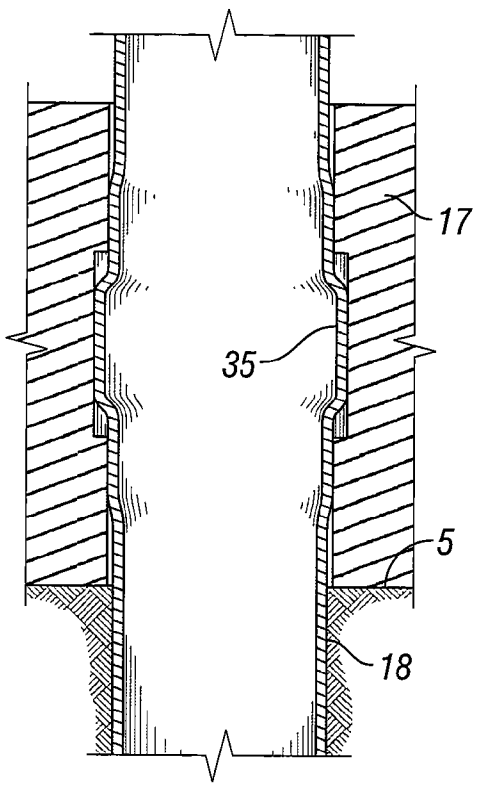
FIG. 6 is a close-up fragmentary elevation view showing the piling after it has been attached to the conical piled monopod.
Figure 5:
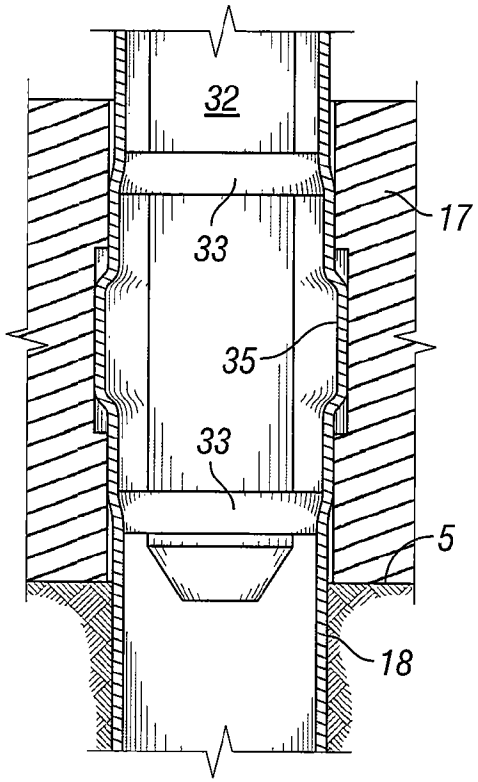
FIG. 5 is a close-up fragmentary elevation view showing the piling being attached to the conical piled monopod.
Figure 4:
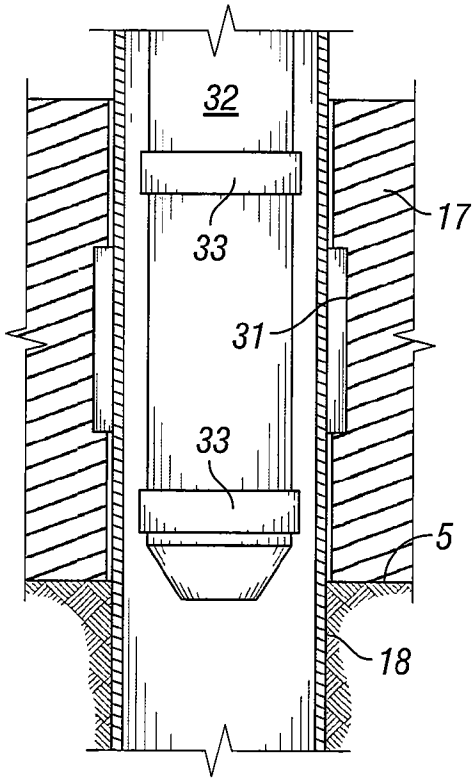
FIG. 4 is a close-up fragmentary elevation view showing a piling after it has been driven into the see bed and prior to attachment to the conical piled monopod.

One known and suitable technique for attaching the pilings 18 to the base 17 is to swage the piling. A simplified explanation is provided in FIGS. 4, 5 and 6 where a swaging tool 32 is inserted into the piling 18, as shown in FIG. 4. The swaging tool 32 seals itself inside the piling 18 with seals 33 and applies hydraulic pressure to deform the piling 18 to seat into one or more peripheral channels 31. The swaging tool 32 is withdrawn and the piling it attached to the base 17 to resist movement of the conical piled monopod 10 in any direction. Another option for securing the pilings 18 to the base 17 include a chemical binder or grout that creates an adhesive bond between the pilings 18 and the base 17. Other techniques may also suitable for securing the pilings 18 to the base 17.

Figure 3:
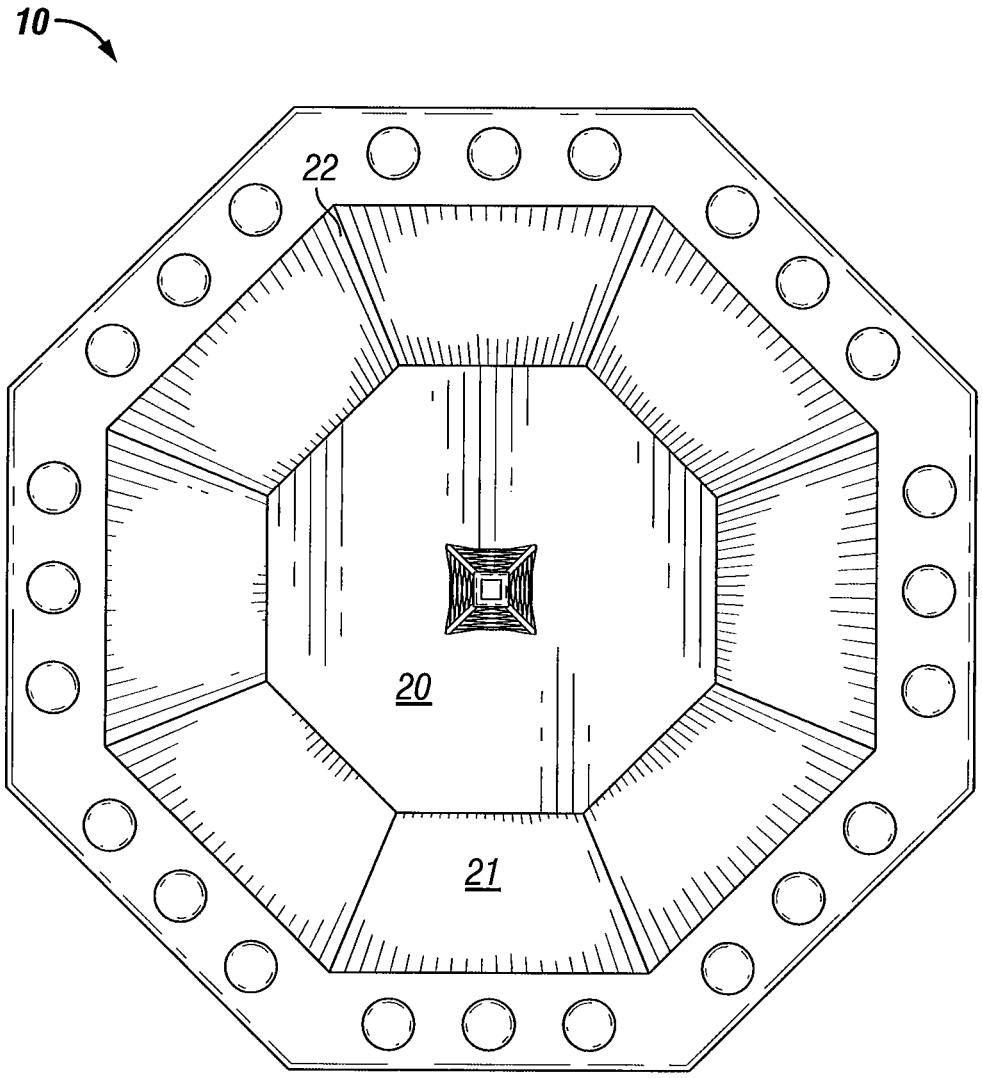
FIG. 3 is a top view of the present invention.

The length and number of the pilings 18 will be dictated by the magnitude of the predicted vertical and lateral forces and by the strength of the soil layers into which the pilings are driven. Preferably, the pilings are strategically arranged around the periphery of the base 17 to provide resistance to sliding and toppling forces with maximum structural efficiency. The base may include at least eight and preferably at least 16 pilings, and up to as many as 64 pilings, around the periphery at a spacing that would maximize structural efficiency and create a pile cluster where the number of clusters work together to resist lateral forces and support the conical piled monopod 10. The pilings 18 typically extend between 35 and 75 meters into the seabed depending on predicted loads and the strength characteristics of the soil. In FIG. 1, the conical piled monopod 10 is shown as an eight sided faceted structure which may be better shown in FIG. 3. A round or circular configuration may also be employed. It is preferred that the structure be faceted for ease of fabrication having six, eight, or even 12 sides, preferably all being equal in dimension and where the conical piled monopod 10 is symmetrical.

The body 15 of the conical piled monopod 10 includes a sloped, ice-engaging surface 21 that extends from a shoulder 22 to a neckline 23. The shoulder 22 is below the sea surface 4 and the neckline 23 is above the sea surface 4 such that ice in the sea, particularly floating ice, engages the body 15 at the sloped, ice-engaging surface 21. The ice-engaging surface 21 extends around the periphery of the conical piled monopod 10 so that ice from any direction will come into contact with the body 15 at the ice-engaging surface 21. The slope of the ice-engaging surface 21 causes any sheet of ice to rise up the slope and bend to a point of breaking and is typically between 40 degrees and 60 degrees from the horizontal and more preferably about 55 degrees from the horizontal. Broken ice chunks, called rubble, will work their way around the body 15, driven by the sea current or wind. Above the neckline 23 is a neck 25 that extends up to the height of the deck, but preferably with an out-turned collar 26 to turn back any ice that slides up the sloped, ice-engaging surface 21 to the full height of the neck 25. The full bending of ice that is engaged with the collar 26 should break even the most robust masses of ice.

The conical piled monopod 10 is a substantial structure typically having a top deck dimension of more than 75 meters across. The conical piled monopod 10 has strength and deck size to support full drilling and production of hydrocarbons. While being large and strong, one advantage of a conical piled monopod over a gravity based structure is that it is generally lighter in weight or more particularly, density, prior to any water ballasting. Solid ballast material is generally not needed for a conical piled monopod. While a gravity based structure (GBS) typically has a density of from 0.21 tonnes/$m^3$ to 0.25 tonnes/$m^3$, a conical piled monopod may be constructed to be 0.20 tonnes/$m^3$ down to about 0.18 tonnes/$m^3$. Often, a GBS would need solid ballast to increase its weight to provide resistance to sliding and overturning. By using piles or a cluster of pilings 18, the conical piled monopod 10 may be designed to be in lighter weight. The lighter density of a conical piled monopod may also translate into lower fabrication and transportation cost, not including the lower installation cost due to the avoided site preparation costs for preparing the seafloor for a large GBS system and for the high density ballast material often added to a GBS.

Figure 2:
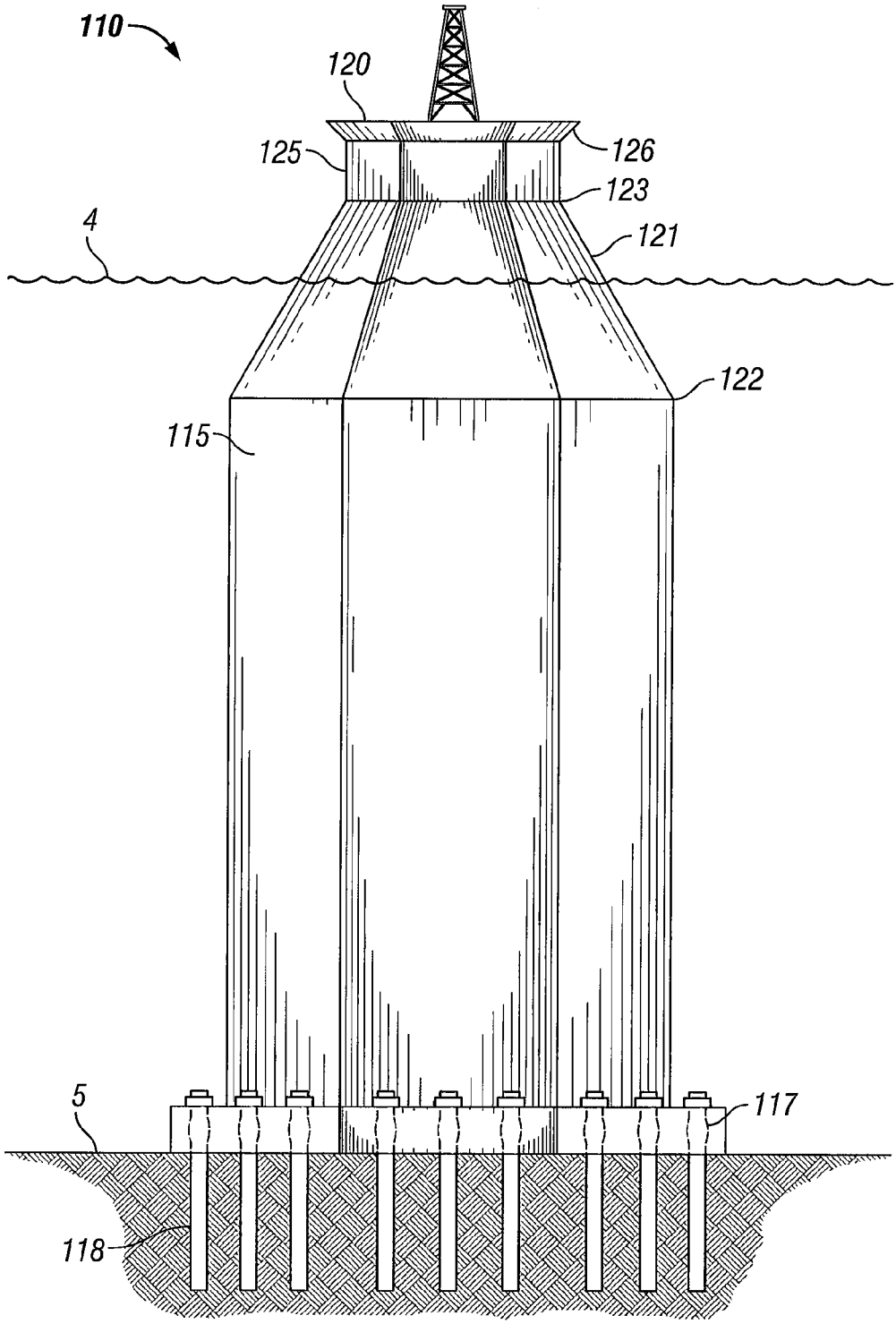
FIG. 2 is an elevation view of a second embodiment of the present invention suited for deeper water.

Turning to FIG. 2, the conical piled monopod 110 may be used in somewhat deeper water with a longer body conical piled monopod 115. It is likely that a longer body conical piled monopod 115 may preferably be designed with some measurable increase in the width dimension as compared to a conical piled monopod 10 for use in shallower water, but perhaps proportionally less increase in width or lateral dimension as compared to the increase in vertical dimension. The base 117 may also be wider compared to the footprint of a shallower design. The conical piled monopod 10 and 110 are both much smaller in weight and width dimension than the GBS arrangement due to the principle reliance on pilings to resist the lateral forces that may be imposed on the system by a maximum predicted ice floe dimension at the production site.

The conical piled monopod 10 is installed at the drill site by transporting the conical piled monopod 10, either towed as a floating object or carried on a super barge and then slipped off of the barge into sea water. Once offloaded from the barge at the location or towed to the location, water is allowed to fill the chambers or compartments within the structure to ballast down the conical piled monopod to the seafloor 5. The pilings 18 are driven into the seafloor 5 to a depth between about 35 meters up to about 75 meters and then attached to the base 17. Ultimately, the weight of the conical piled monopod 10 is supported by the deeply installed pilings 18.

In review, the conical piled monopod 10 has a platform geometry that is conducive to reducing ice loads having the shape of a frustum of a cone with a narrow top and wider base. Most of the surface of this conical shaped structure that is contacted by moving ice is sloping. The sloping surface forces the moving ice to fail in bending as it turns upwards upon contact with the platform structure. Secondly, the conical piled monopod 10 relies on piles driven deep into seafloor to structurally resist the tendency for overturning or sliding at the base of the structure with large diameter piles driven deep into the seafloor and integrated or firmly attach to the platform around its periphery. The piles are driven deep enough into the seafloor so that they cannot be "uprooted" by the moving ice forces that act on the structure at some height above the seafloor. The steel piles act as a pile cluster and are very structurally efficient in providing significant resistance to sliding as well as significant resistance to overturning caused by ice forces acting on the platform. Thirdly, a conical piled monopod 10 eliminates the need and cost for removing soft soils on the seafloor directly beneath the base of the structure and replacing them with gravel or other hard material.

In closing, it should be noted that the discussion of any reference is not an admission that it is prior art to the present invention, especially any reference that may have a publication date after the priority date of this application. At the same time, each and every claim below is hereby incorporated into this detailed description or specification as an additional embodiment of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

The invention claimed is:

1. A conical piled monopod structure for use in ice prone offshore environment wherein the conical piled monopod comprises: a body with a base at the bottom and a top deck at the top wherein the base is attached to pilings that are driven into a muddy seafloor when the conical piled monopod structure is installed for use, a shoulder, a neckline and an inclined faceted ice engaging surface around the body extending from the shoulder to the neckline where the ice-engaging surface is inclined from a wider lower region at the shoulder to a narrower neckline and has sides corresponding in number to sides of a polygon shape defined by the shoulder and where the shoulder is arranged to be below the sea surface and the neckline is arranged to be above the sea surface wherein the top deck at the top of the body is at least 60 meters across and the monopod structure has a density of less than about 0.20 tonnes/$m^3$.

2. The conical piled monopod structure according to claim 1 wherein the pilings are greater than or equal to 35 meters below the base.

3. The conical piled monopod structure according to claim 1 wherein the pilings are greater than or equal to 60 meters below the base.

4. The conical piled monopod structure according to claim 1 wherein the deck is at least 65 meters across.

5. The conical piled monopod structure according to claim 1 wherein the deck is at least 75 meters across.

6. The conical piled monopod structure according to claim 1 wherein the pilings are hollow tubes or pipe structures with a diameter greater than or equal to 1 meter.

7. The conical piled monopod structure according to claim 1 wherein the pilings are greater than or equal to 2 meters in diameter.

8. The conical piled monopod structure according to claim 1 wherein the polygon shape has at least six sides.

9. The conical piled monopod structure according to claim 1 wherein the pilings are swaged to the base for carrying weight of the structure.

10. The conical piled monopod structure according to claim 1 wherein the pilings are each a hollow tube deformed to seat into a peripheral channel along a perforation through the base where the tube passes.

11. A method for providing a structure at a hydrocarbon production location with a muddy seabed in an ice prone offshore environment, where the method comprises:

providing a monopod structure having a body, a base at the bottom and a deck at the top that is at least 75 meters across and wherein the body has a density of less than about 0.20 tonnes/$m^3$;

floating the monopod structure to the hydrocarbon production location;

lowering the base to the seabed where the body is relatively vertically upright and the deck is above the sea surface and relatively level;

driving pilings through apertures in the base to hold the monopod structure in place against the forces of wind, sea and ice; and arranging for a faceted sloped ice-engaging surface to extend from below the sea surface to above the sea surface so as to bend ice that comes in contact with the monopod structure and cause the ice to break, resulting in reduced lateral forces on the structure compared to a vertical faced surface, wherein the faceted sloped ice-engaging surface has sides corresponding in number to sides of a polygon shape defined by a perimeter of the monopod structure.

12. The method for providing a structure at a hydrocarbon production location in an ice prone offshore environment according to claim 11 wherein the pilings extend greater than or equal to 35 meters into the seafloor.

13. The method for providing a structure at a hydrocarbon production location in an ice prone offshore environment according to claim 11 wherein the pilings extend greater than or equal to 50 meters into the seafloor.

14. The method for providing a structure at a hydrocarbon production location in an ice prone offshore environment according to claim 11 wherein the deck is at least 65 meters across.

15. The method for providing a structure at a hydrocarbon production location in an ice prone offshore environment according to claim 11 wherein the deck is at least 75 meters across.

16. The method for providing a structure at a hydrocarbon production location in an ice prone offshore environment according to claim 11 wherein the pilings are greater than or equal to 1 meter in diameter.

17. The method for providing a structure at a hydrocarbon production location in an ice prone offshore environment according to claim 11 wherein the pilings are greater than or equal to 2 meters in diameter.

18. The method for providing a structure at a hydrocarbon production location in an ice prone offshore environment according to claim 11 wherein the polygon shape has at least six sides.

19. The method for providing a structure at a hydrocarbon production location in an ice prone offshore environment according to claim 11 further comprising swaging the pilings to the base for carrying weight of the structure.

20. The method for providing a structure at a hydrocarbon production location in an ice prone offshore environment according to claim 11 further comprising inserting a swaging tool into the pilings and deforming the pilings into peripheral channels along perforations through the base where the pilings pass.

* * * * *